US005990620A

United States Patent [19]

Lepselter

[11] Patent Number: 5,990,620

[45] Date of Patent: Nov. 23, 1999

[54] PRESSURIZED PLASMA DISPLAY

[76] Inventor: Martin P. Lepselter, 25 Sweetbriar, Summit, N.J. 07901

[21] Appl. No.: 08/941,156

[22] Filed: Sep. 30, 1997

[51] Int. Cl.[6] ..... H01J 17/20; H01J 17/06

[52] U.S. Cl. ..... 313/585; 313/586; 313/492

[58] Field of Search ..... 313/582, 584, 313/485, 486, 489, 491, 492, 585, 586, 587; 315/169.4

[56] References Cited

U.S. PATENT DOCUMENTS

| | | | |
|---|---|---|---|
| 3,899,707 | 8/1975 | Sasaki et al. | 313/582 |
| 3,916,245 | 10/1975 | Dorf et al. | 313/486 |
| 3,983,445 | 9/1976 | Yasuda et al. | 313/485 |
| 4,224,553 | 9/1980 | Hellwig | 313/489 |
| 4,292,631 | 9/1981 | Gerard | 315/169.4 |
| 4,325,002 | 4/1982 | Kobale et al. | 313/485 |
| 4,341,976 | 7/1982 | Hanlet | 315/169.4 |
| 4,529,909 | 7/1985 | Kamegaya et al. | 313/584 |
| 5,175,473 | 12/1992 | Kim | 315/169.4 |
| 5,438,236 | 8/1995 | Evans | 313/582 |
| 5,453,660 | 9/1995 | Martin et al. | 313/582 |
| 5,469,021 | 11/1995 | Lepselter | 313/582 |

*Primary Examiner*—Michael Day
*Attorney, Agent, or Firm*—Darby & Darby

[57] ABSTRACT

A miniature high resolution plasma display suitable for integration on a semiconductor chip in combination with other circuitry is comprised of two crossed sets of conductors which are arranged on a first substrate to form an array of crosspoints. The two conductors at each crosspoint are a preselected distance apart and separated by a hollow cavity. An array of vertical tubes in a second substrate is spaced so as to correspond to the array of crosspoints. The second substrate is supported in alignment with the first so that the open end of the tubes oppose the cavity at each crosspoint. The tubes and cavities are filled with a pressurized gas and the assembly is sealed with a transparent, electrically conducting coverplate. When a voltage greater than or equal to the Paschen minimum firing voltage is applied across the cavity at a crosspoint, a plasma is created. Ions in the plasma spread from the cavity into the tube in response to a voltage that is applied to the cover plate. The charged particles in the plasma combine within the tube to generate light.

33 Claims, 7 Drawing Sheets

PRESSURIZED PLASMA DISPLAY

FIELD OF THE INVENTION

This invention relates to a miniature high resolution plasma display and in particular to a high resolution plasma display for integration on a silicon substrate.

BACKGROUND OF THE INVENTION

Plasma displays have been known since the late 1960's. A plasma display encloses a gas or mixture of gases between crossed and spaced conductors. The crossed conductors define a matrix of cross over points, arranged as an array of miniature picture elements (pixels) or lamps which provide light. At any given pixel, the crossed and spaced conductors function as opposed plates of a capacitor, with the gas serving as the dielectric. When a sufficiently large voltage is applied, the gas at the pixel breaks down into a plasma of electrons and ions which glow as the electrons and ions in the plasma combine in the local region of that pixel. The discharge, if not within the visible spectrum (e.g., ultraviolet light), may be converted to visible light by use of phosphors.

The voltage required to illuminate a given pixel is governed by Paschen's Law. Under Paschen's Law, the voltage at which a gas breaks down into a plasma, the so-called spark or firing voltage, is related to the product of the pressure of the gas, p (in mm Hg), times the distance d (in cm), between the electrodes. By scanning the conductors (for example sequentially) with a voltage sufficient to cause the pixels to illuminate, and repeating the process at least 60 times per second, a steady image can be perceived by the human eye.

Plasma displays are typically large scale devices. Conventional miniature displays are manufactured using liquid crystal display (LCD) technology. LCD's have been successfully fabricated at high pixel densities but, unlike plasma displays, the LCD pixels themselves are not self-illuminating. Instead, LCD displays require auxiliary lighting from behind to illuminate the pixels. Furthermore, it is difficult to fabricate LCD displays on a transparent substrate that permits back lighting. Thus, conventional high-resolution miniature LCD arrays are first fabricated on one substrate and then the entire LCD array structure is "transferred" from to a second transparent substrate. A separate back light must also be provided, along with an external interface to connect the miniature LCD array to the control circuitry. Further, an LCD display requires a separate driver for each pixel. This increases the area each pixel requires on the substrate and thus reduces the maximum pixel density.

The present invention solves problems in the art by providing a self-illuminated miniature high-resolution plasma display that can be integrated and operated on a single semiconductor substrate using conventional semiconductor fabrication techniques.

SUMMARY OF THE INVENTION

The present invention provides a miniature high resolution plasma display that operates with either alternating or direct current. The plasma display comprises an array of plasma emitters which is formed according to one aspect of the invention by two sets of crossed conductors. A first set of conductors is disposed on a first substrate. An insulating layer of spacing material is supported on the substrate and a second set of conductors is disposed on the spacing material and arranged to cross over the first set of conductors to form an array of crosspoints. An array of cavities within the spacer material is disposed between or adjacent the conductors such that a cavity exists at each crosspoint. The cavities define the discharge area where plasma is generated by the plasma emitters.

A second substrate made of a material such as silicon or PYREX glass (or other material which is preferably thermally matched to the first substrate) has an array of tubes formed therein. The inner surface of the tubes is lined with a phosphor layer. The second substrate is positioned so that the tubes are aligned substantially identically with the array of cavities in the first substrate. The first and second substrates, so aligned, are connected to form a unitary structure. A transparent cover plate is disposed on one side of the second substrate. A gas is contained within the tubes and cavities and sealed between the second substrate and the first substrate to define a discharge cavity.

The gas contained in the discharge cavity between the two sets of conductors at each crosspoint undergoes light emissive discharge when the Paschen minimum firing voltage is applied across that crosspoint. The excited plasma spreads from the discharge cavity into an adjacent tube in response to a voltage that is applied to the conducting cover plate. The ions and electrons in the plasma combine within the tube and generate ultraviolet light which excites the phosphor layer in the tube and thereby produces visible light in pre-selected colors, such as white, red, green, or blue, depending on the selected phosphor.

An important feature of the invention is that the gas contained in the cavities and tubes is preferably contained at or above atmospheric pressure. This pressure range permits the two conductors to be very closely spaced. Further, conventional fabrication techniques used in the semiconductor industry are viable to fabricate the above-described high density array of crosspoints. Thus, a miniature high resolution plasma display according to the invention is mass producible at relatively low cost using conventional techniques. Preferably, control circuitry for the display is integrated onto the first substrate.

Another aspect of the invention is the area multiplier formed by the array of tubes within the second substrate. The tubes extend into a third dimension, in contrast with essentially planar conventional displays and therefore have a large internal surface area on which the phosphor layer is disposed. This provides greater light-emitting efficiency without increasing the area of the planar display on the first substrate. Further, the surface area in the tubes may be increased by increasing the number of tubes or by increasing the thickness of the second substrate and the length of the tubes therein. One long tube or a plurality of relatively shorter tubes may be disposed adjacent a single crosspoint or pixel to multiply the phosphor light-emitting area by an order of magnitude or more. The area multiplier can be coupled not only to an array of plasma emitters but can also be used with arrays of other types of light-emitting display elements where the increased phosphor area will enhance the output of the display.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
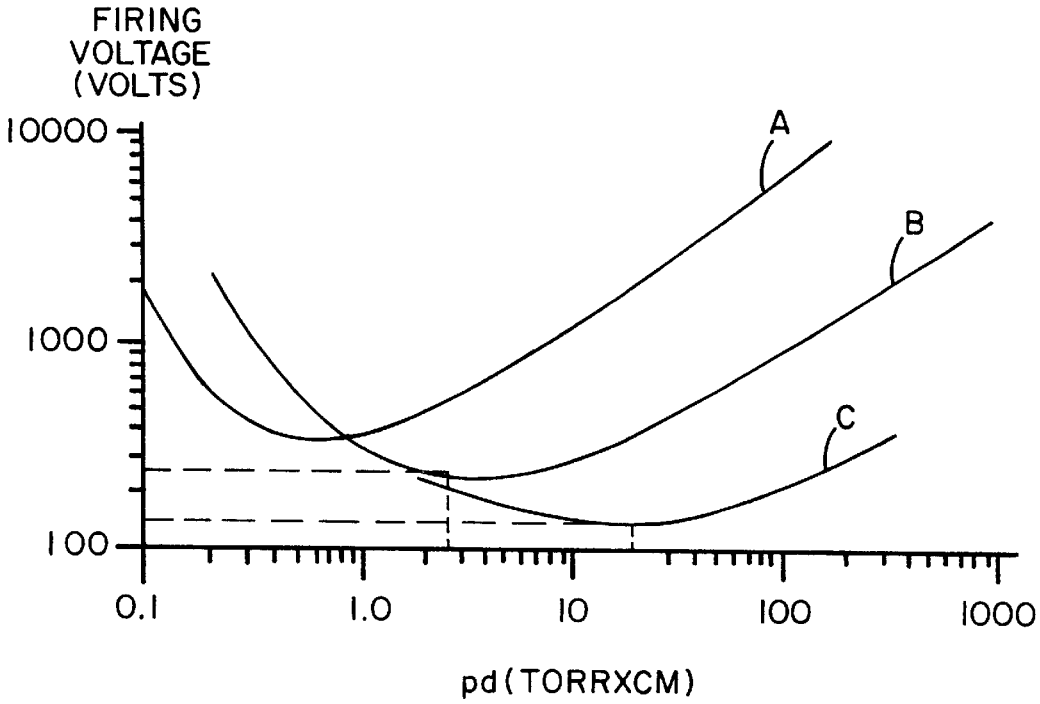
FIG. 1 is a diagram for explaining Paschen's law.

In accordance with Paschen's Law, every gas has a characteristic minimum firing voltage, Vmin, associated with a particular pressure-distance ("pd") product, the product of the pressure of the gas, p (in mm Hg), times the distance d (in cm), between the electrodes (see FIG. 1). The firing voltage rises above this minimum at all other values of the pd product. In the region below curve A, B or C, a gas will not spark and there will be no initial discharge; however, an existing discharge can be sustained with voltages in this region. It is generally desirable to design a gas discharge display to operate at or near the Paschen minimum firing voltage in order to lower the needed voltages.

The overall size of a plasma display is largely dependent on the distance between the electrodes and the electrode size. The display size can thus be reduced by decreasing the distance between the electrodes and making them small enough to be densely arranged. Under Paschen's law, the distance may be reduced without increasing Vmin by increasing the pressure of the gas. For example, if the electrodes are positioned one micron apart, and a gas pressure of 7630 mm Hg is used, (10 atmospheres) a pd product of 0.763 mm Hg cm results. This value is substantially near the Vmin for gases such as Nitrogen with 5% Xenon which generate ultraviolet light when excited into a plasma.

Figure 2:
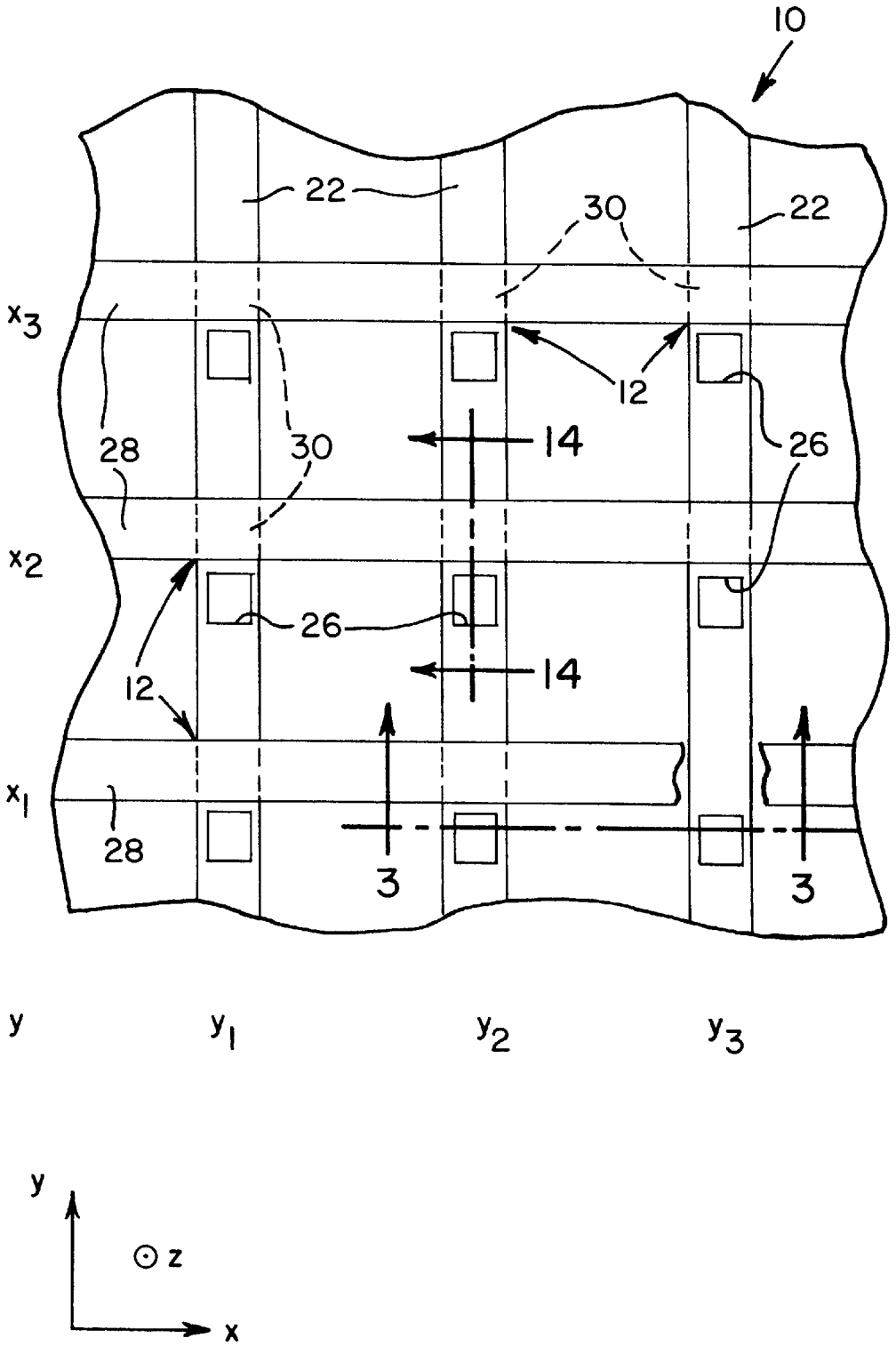
FIG. 2 is a top plan view of a portion of a miniature high resolution plasma display constructed according to one embodiment of the present invention.
Figure 3:
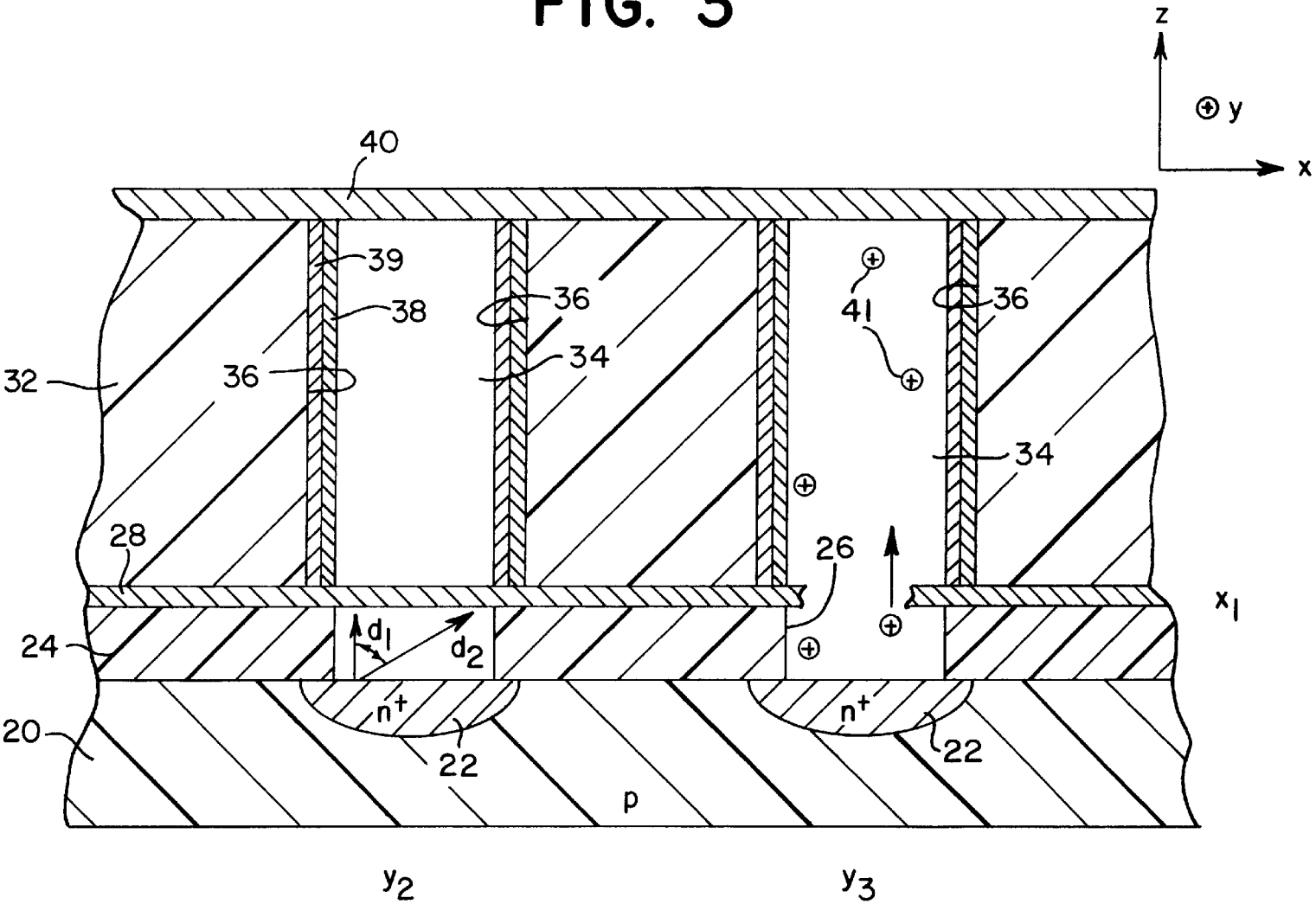
FIG. 3 is a cross-sectional view of FIG. 2 along line 3—3.

FIG. 2 shows a top plan view portion of a display 10 comprising an array of plasma emitters 12 (alternatively referred to as pixels) according to the present invention. FIG. 3 is a cross-sectional view two pixels of FIG. 2 along line 3—3. The plasma display 10 is formed on a substrate 20 which preferably is p-type silicon. A set of conductors 22 (here shown as n+ diffusions regions in substrate 20) are disposed the y-direction. An insulating layer 24 is positioned over the first set of conductors 22. The layer 24 has an array of cavities 26 which expose a portion of conductors 22 at or near the locations of the crosspoints 30, described next. A second set of conductors 28 disposed in the x-direction defines rows which cross over the first set of conductors 22 to define an array of crosspoints 30. Each crosspoint 30 and associated cavity 26 forms a plasma emitter 12, the operation of which is discussed below.

An array of plasma emitters 12 may be formed having other configurations, as will be apparent to those skilled in the art. One skilled in the art will also recognize that conductors 22 and 28 need not be linear strips of conductive material as shown, but may be crossed sinusoids, square or triangular wave patterns or the like. Although the cavities 26 are illustrated as being rectangular areas, as used herein, a cavity 26 is defined as an open region between or adjacent a plurality of conductors within which, when the cavity contains a gas, a plasma discharge can occur upon application of a sufficient voltage to the conductors. Thus, several cavities 26 can exist within a single open region extending across several diffused conductors 22.

A second substrate 32 has an array of tubes 34 formed in it which are arranged to correspond to the array of plasma emitters 12 (here formed by crosspoints 30 and associated cavities 26). The second substrate 32 is positioned relative to the first substrate 20 such that the array of tubes 34 is in register with the discharge cavities 26 of the array of plasma emitters 12. As a result, an array of substantially hollow chambers is defined by the aligned cavities 26 and tubes 34. Although only one tube per crosspoint is shown, it is understood that the array of tubes 34 may be such that many tubes are in register with each plasma emitter 12. In the preferred embodiment, the tubes have a substantially rectangular cross-section. However, the cross-section of tubes 34 may be of any shape and the shape may vary along the length of the tubes 34.

A phosphor layer 38 is disposed on the side walls 36 of tubes 34. Preferably, a "silvered" reflecting layer 39 is disposed the side walls 36 beneath the phosphor layer 38. The chambers contain a gas suitable for producing a plasma discharge, such as Argon, Nitrogen or Neon with the addition of 5% Xenon, and the tubes 34 are sealed at their ends facing away from the first substrate 24 with a transparent conducting cover plate 40. The gas is preferably at or above 0.8 atmospheres and more preferably at several atmospheres. One preferred material for cover plate 40 is PYREX coated with indium tin oxide because of this coating's known transparency in the visible spectrum and electrical conductivity. Although a high pressure gas will exert a force on the cover plate 40 and the structures adjacent cavities 26 and tubes 34, the overall force exerted is minimal because of the very small area-to-perimeter ratio.

When a voltage difference above the minimum Paschen firing voltage, Vmin, is applied to a plasma emitter 12 formed by crossed conductors 22 and 28 and cavity 26, the gas in the cavity 26 at that selected crosspoint 30 breaks down into a plasma of charged particles 41. (See FIG. 3). Breakdown at Vmin will occur between a point on conductor 22 and a point on conductor 26 which are a distance d apart in accordance with Paschen's law, discussed above. There may be many possible locations within each crosspoint at the proper distance d and the overlapping nature of the crossed conductors 22 and 28 allows for a range of possible distances d depending on the discharge path between the conductors. For example, a direct path may have a distance $d_1$, whereas a diagonal path provides a longer distance $d_2$, as illustrated. In operation, the system will find the discharge path best suited to the actual gas pressure and applied voltage.

Applying an appropriate voltage to the conducting cover plate 40 causes the plate 40 to function as a virtual cathode (or anode, depending on the voltage polarity) which draws plasma created by the plasma display element from the cavity 26 into the tube 34. The ions and electrons in the plasma combine to produce light, which for many gases occurs in the ultraviolet range of the electromagnetic spectrum. The ultraviolet discharge in the tube 34 interacts with the phosphor 38 on the walls 36 of the tube 34 to produce visible light which can be seen through the transparent cover plate 40. If the assembly is made with tubes 34 that have heights (z-direction in FIG. 3) significantly greater then their diameter (x-direction in FIG. 3), the structure at each crosspoint 30 becomes, in effect, an integrated array of fluorescent light bulbs.

The array of plasma emitters 12 and associated tubes 34, in conjunction with appropriate support circuitry, comprises a miniature plasma display 10 according to the present invention. A miniature color display is provided by grouping the pixels into triads, where each triad has three elements with different phosphors to generate the red, green, and blue primary colors. Alternately, a white phosphor can be used and appropriate color filters can be formed on coverplate 40.

Using a vertical tube structure over each cavity 26 in a plasma emitter 12 provides multiplication of the surface area on which phosphor may be deposited, greatly increasing the display efficiency as compared with pure planar displays without increasing the amount of area required by the display on the silicon substrate. For example, a planar display with a discharge cavity 26 of length and width w and negligible height a surface area of $w^2$ on which phosphor may be applied. A tube with a square cross-section of the same size as the cavity 26 but having a height h provides a vertical surface area equal to 4*h*w.

The ratio between the two- and three-dimensional structure, 4*h/w is a measure of the degree this area multiplier improves display efficiency. Where h is larger than w, a large area multiplication is achieved with a single tube. For example, where w is 10 microns and h is 100 microns, the phosphor area, and thus the display efficiency, is increased by a factor 40. When w is larger than h, area multiplication is achieved by providing many tubes for each discharge region. For example, a width w of 10 mm gives a planar surface area of 100 $mm^2$. For a height h of 5 mm, an array of 100 tubes with a width of 0.5 mm (a 10×10 array) gives a total area of 4 * 5 mm * 0.5 mm * 100=1000 $mm^2$, an improvement by a factor of ten.

Although the preferred embodiment comprises plasma emitters formed by an array of crosspoints 30 and cavities 26, the present invention is not limited to this particular arrangement and those skilled in the art will recognize that the vertical tube structure described above may be coupled with array of plasma emitters of any particular conductor configuration. The area multiplier can also be easily adapted for use with arrays of other types of light-emitting display elements where the increased phosphor area will enhance the output of the display.

Figure 4:
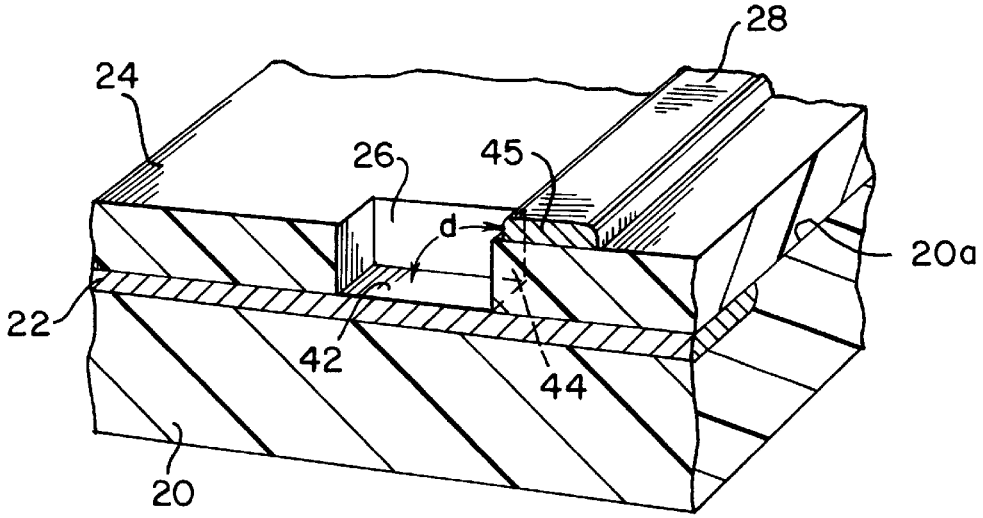
FIG. 4 is a cross-sectional perspective view of FIG. 2 along line 4—4 illustrating a partially fabricated plasma display element.

A miniature plasma display 10 according to the present invention can be fabricated at high pixel densities using conventional semiconductor fabrication techniques. One method of fabrication is discussed with reference to FIGS. 4 through 6. The display 10 is formed on a substrate 20, preferably of p-type silicon. (FIG. 4). The first set of conductors 22 may be formed as y-directed n+ diffusion layers by conventional techniques. An insulating layer 24, such as $SiO_2$, is grown on the body 20 with an array of cavities 26 is formed therein. (Alternatively, the insulating layer 24 may be formed first and used to define the diffusion regions for the first set of conductors 22). A second set of conductors 28, preferably a non-sputterable metal such as Zirconium, is then deposited and patterned on the insulating layer.

There are many ways in which the second set of conductors 28 may be arranged relative to cavities 26 to form the array of crosspoints. In the preferred embodiment, conductors 28 are deposited adjacent the cavities 26 along ledge 45 as shown in FIG. 4. One method for arranging the conductors 28 in this manner is discussed in U.S. Pat. No. 4,292,631 to Gerard entited "Plasma Matrix Display Unit," filed on Mar. 24, 1980, the contents of which are hereby incorporated by reference in its entirety as if set forth herein. In this embodiment, a cavity 26 is defined as the open region bounded by exposed region 42 of conductor 22 and by side wall 44 adjacent conductor 28.

As shown in FIG. 4, the conductors 22, 28 at crosspoints 30 are supported on a single substrate 20 at a preselected and uniform distance apart so that the same voltage signal can induce glow discharge at any of the crosspoints 30 in the array. Because the thickness of insulating layer 24 can be controlled with great accuracy during fabrication relative to the top surface 20*a* of the substrate 20, layer 24 provides local thickness control at each crosspoint 30 of the entire array of crosspoints which comprise the display 10, regardless of any local surface inhomogeneities such as warp or waviness in the surface 20*a*.

In a preferred embodiment, the conductors are spaced substantially one micron apart in the z-direction. This spacing allows for very high crosspoint density and therefore a very high resolution display in a small chip area. At this spacing, a plasma discharge can be induced at the Vmin for conventional gasses such as Nitrogen (with the addition of 5% Xenon to enhance ultraviolet light production) at a gas pressure of approximately ten atmospheres, as discussed above. Preferably, the width of conductors 22, 28 is approximately from 2 to 10 microns and the cavities 26, and thus the pixel size, are approximately from 10 to 20 microns along each side.

Figure 5:
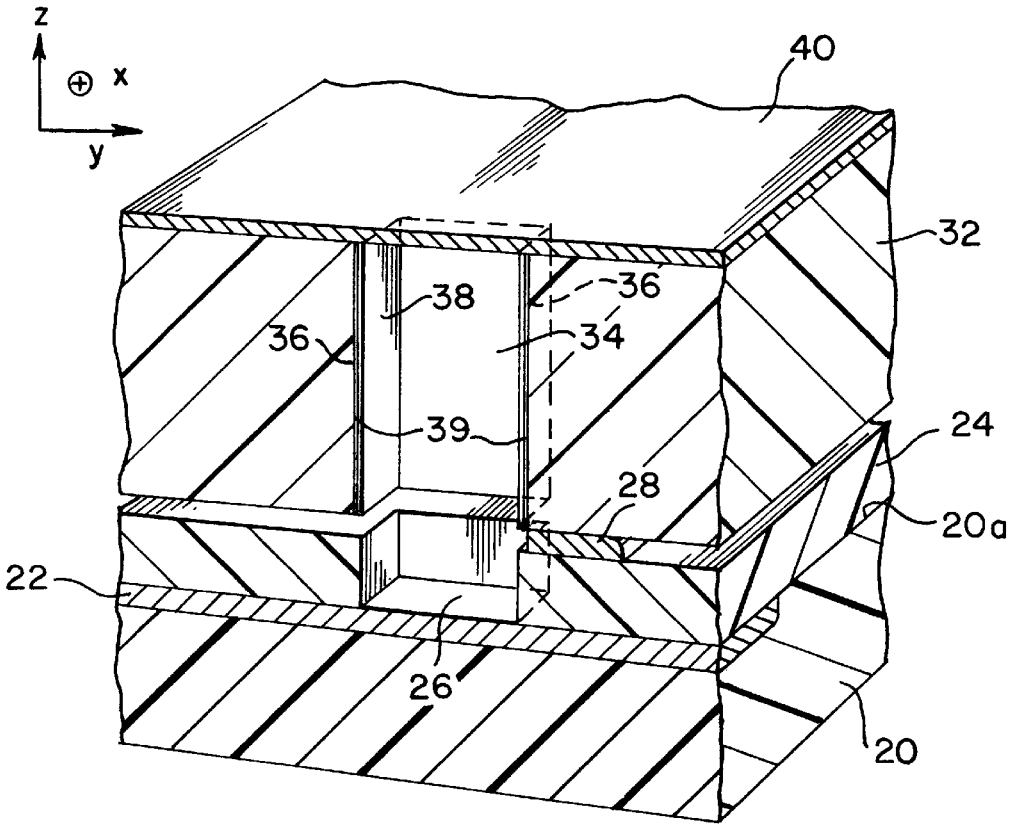
FIG. 5 is a cross-sectional perspective view of FIG. 2 along line 4—4 illustrating a completed plasma display.

The remaining fabrication steps will be discussed with reference to FIGS. 5 and 6. The second substrate 32 is comprised of a material which has a similar thermal coefficient of expansion in to the first substrate 20. In a preferred embodiment, substrate 32 is of silicon or PYREX AE glass. Substrate 32 is processed to form an array of tubes 34 therein and spaced so that one or more tubes in the array corresponds to each of the crosspoints 30. Tubes 34 may be formed in substrate 32 by conventional pattern techniques combined with anisotropic etching, reactive ion etching or water etching and are preferably longer in the Z direction than they are wide (in the x- and y-directions).

In the water etching (or honing) process, a very narrow stream of water containing an abrasive material is projected at high velocity through an overlay mask onto the substrate 32. An advantage of this technique is that it is highly directional and provides an aspect ratio of tube length versus diameter of as great as about 50:1. For example, tubes 34 may be formed in substrate 32 which are 100 microns long or deep and only about 10 microns wide over the entire length of the tube. In a preferred embodiment, substrate 32 is greater than 100 microns thick and the tubes 34 penetrate substrate 32 completely. One end of the tubes 34 is sealed by the coverplate 40. The tubes are preferably tapered to be wider at the top than the bottom. Tapering the tubes allows reflected light to propagate upwards and thereby facilitates light escaping from the tube through the coverplate.

After tubes 34 are formed, a layer of phosphor 38 is deposited on the walls 36 of tubes 34. Advantageously, phosphor layer 38 is formed with a grain structure having a grain size selected to prevent lateral transmission ("trapping") of light within the layer 38. Preferably, prior to applying the phosphor 38, the walls 36 of the tubes are "silvered" by depositing a highly reflective coating 39 of a material such as silver or aluminum to increase light reflectance. The combination of silvering and tapering of the tubes greatly increases the amount of light which escapes through the cover plate to be viewed by the observer, and thus increases display efficiency.

Figure 6:
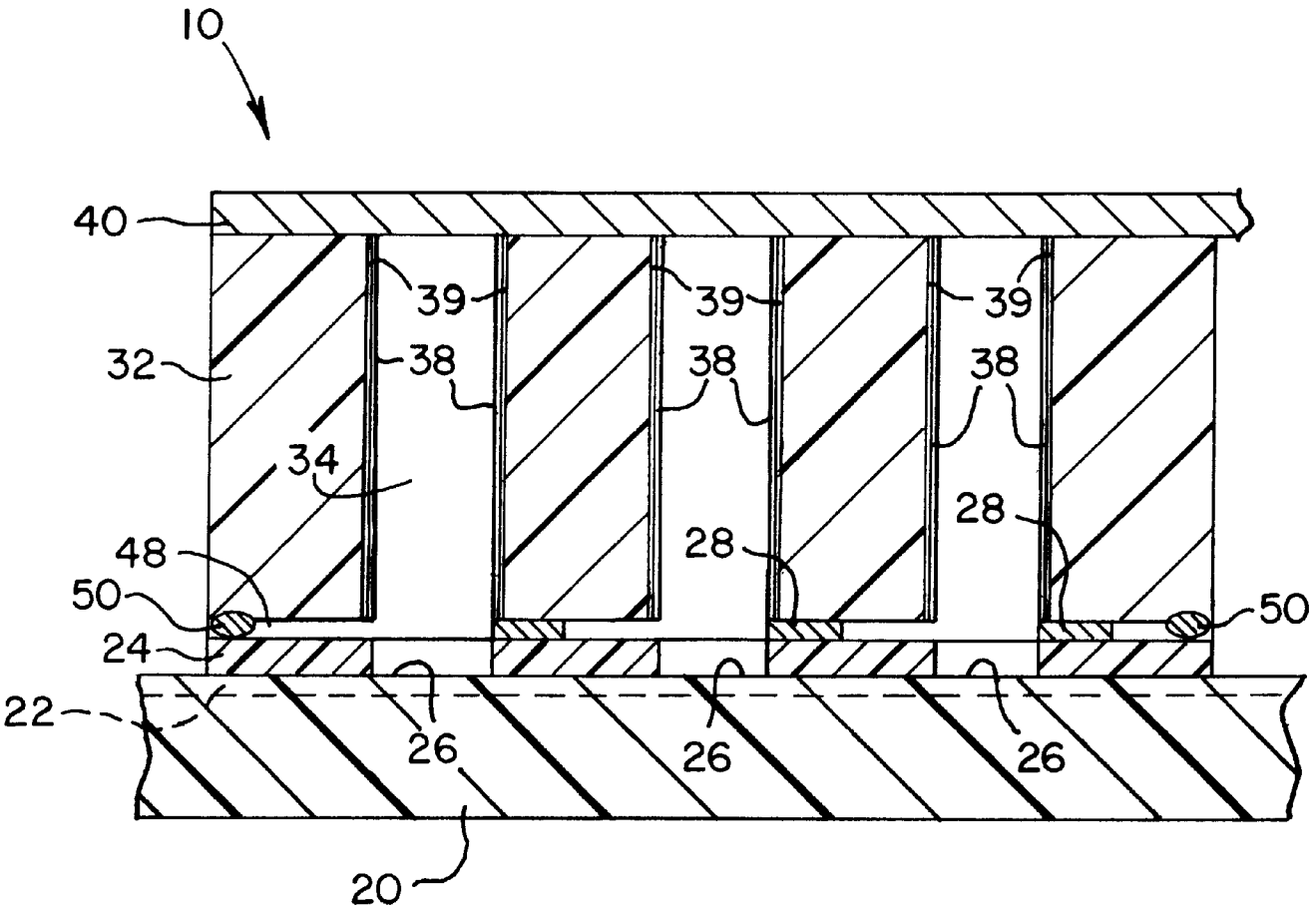
FIG. 6 is a cross-sectional view of a plurality of display elements as in FIG. 5, further showing the two substrates are bonded together according to one embodiment of the invention.

As shown in FIG. 6, the array of tubes 34 is then aligned with the plasma emitters 12 formed by cavities 26 and crosspoints 30 on the substrate 20, and the substrate 32 is bonded along its edges to substrate 20 with e.g., a metal ring or glass bead 50. Alternatively, substrate 32 is bonded to substrate 20 prior to the formation of tubes 34. To those skilled in the art, the two substrates can be aligned with a precision, for example, on the order of one micron tolerance. It can be appreciated that if the size of the plasma emitters 12 are large compared with the cross-section of the tubes 34, alignment is less critical as many tubes 34 will be in register with each cavity 26 of the plasma emitter so long as the array of tubes 34 is positioned over the array of plasma emitters.

Finally, the structure is filled with a pressurized gas such as Nitrogen, Argon or Neon with 5% Xenon and sealed by a transparent, conducting coverplate 40 which forms a terminating wall for the tubes 34. Preferably, coverplate 40 is glass coated with tin oxide and its derivatives, such as indium tin oxide (ITO). Derivatives of tin oxide, as used herein, are meant to embrace at least the family of ternary compounds which include an element plus tin and oxygen, as well as compounds containing more than three elements. The pertinent virtue of tin oxide and some of its derivatives is that they are transparent and electrically conductive. Those skilled in the art will recognize that the tubes may also be formed so that the coverplate is integral with the second substrate.

In the preferred embodiment, the enclosed gas is pressurized to substantially ten atmospheres. It is not necessary that the individual pixels be sealed off from each other and, in practice, the hollow areas in each pixel (comprised of cavities 26 and tubes 34) will be connected by gas-filled channels 48, thus forming a continuous distribution of gas within the display 10.

Because the display 10 is supported on a silicon substrate 20, series resistors, one-per-cell, can be fabricated for DC operation of the display, e.g., by using conventional JFET pinch-off technology. Additionally, other circuits can be fabricated on the same substrate 20 as the display. For example, the drivers for the display 10 as well as memory buffer and various interface circuits can be combined with the display 10 to form a fully integrated display device on a single chip.

Figure 7:
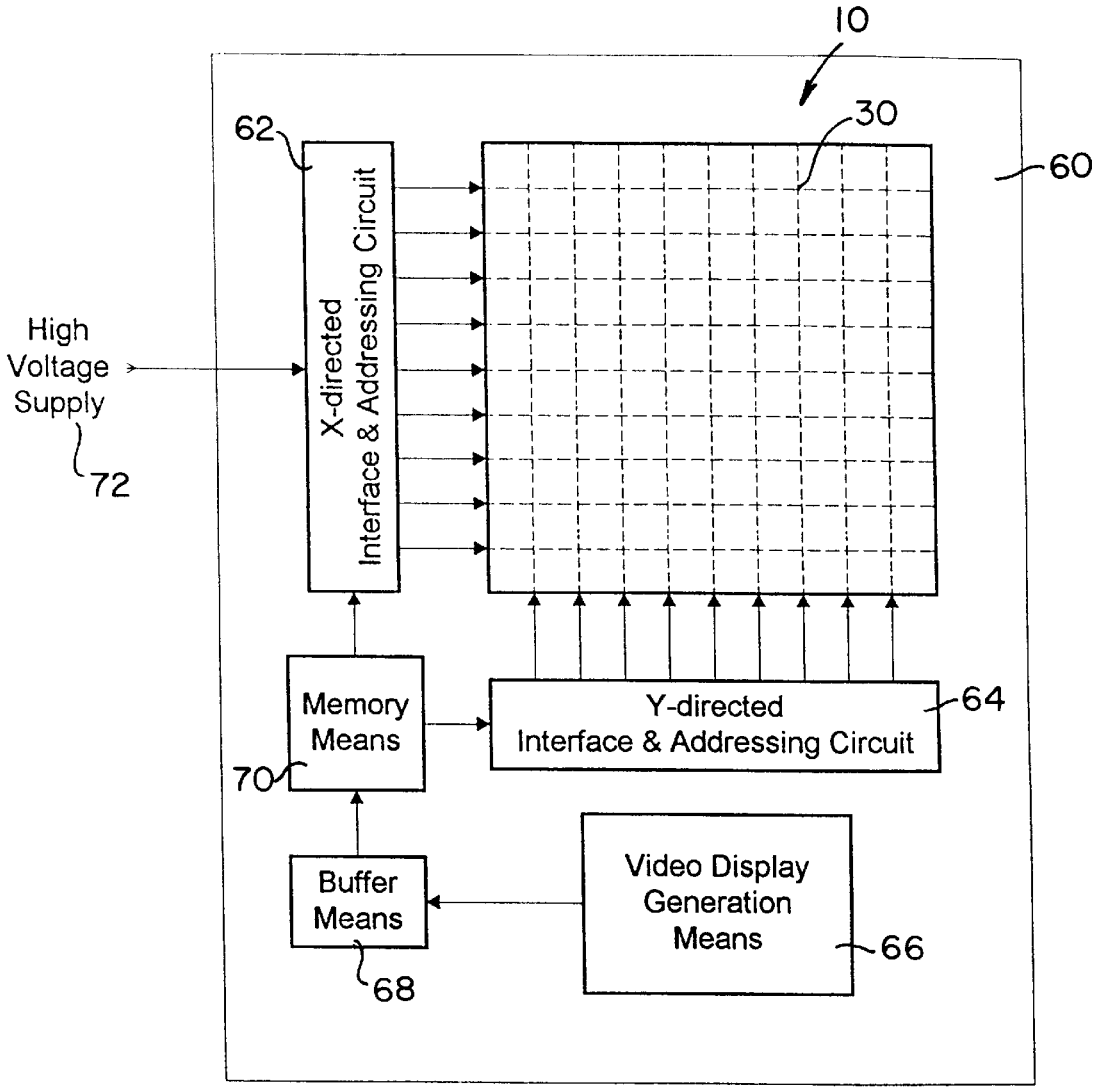
FIG. 7 is a block diagram illustrating a miniature high resolution plasma display and associated control circuitry integrated on a chip.

FIG. 7 is an illustration of an integrated circuit 60 incorporating a plasma display 10. The display 10 is driven by x- and y-directed interface and addressing circuits 62, 64. The image to be displayed is generated by the video display generation means 66. The image is preferably represented by a digitized array of pixels, advantageously addressable by row and column coordinates corresponding to like coordinates of the crosspoints 30 forming the plasma emitters in the display 10. Buffer means 68 stores the addressable image data in conventional manner, by row and column coordinates. The stored image data may comprise status, intensity, and color level information. A memory means 70 may receive one image frame from buffer means 68 so that the next image may be loaded into buffer means 68.

In operation, the pixels of display 10 are addressed or scanned sequentially, a row at a time, by interface and addressing circuits 62, 64. A voltage from high voltage supply 72 is selectively applied to crosspoints 30 in accordance with the status and intensity information associated with each pixel of a given image frame. The interface and addressing circuits 62, 64 scan the display 10 at least 60 times per second so that a human eye may perceive a steady image.

The plasma display 10, according to the invention, overcomes a significant and limiting factor of the achievable resolution of conventional display technology. The pixel density for miniature displays must be high enough to supply acceptable resolution when the display area is enlarged for viewing. As an example, a conventional high resolution fax image has a pixel density of 180 dpi. (By contrast, the best computer monitors have a resolution of about 90 dpi.) A standard 8.5 inch fax with one inch margins thus has approximately 1,200 pixels per line.

A miniature plasma display 10 having a pixel spacing of about 25 micrometers (in the x- and y-directions) easily may be made using conventional processing techniques. An integrated plasma display having 1,200 by 1,200 pixels can be integrated onto a chip only 3 cm×3 cm (a pixel density of approximately 1000 dpi). The 25 micrometer pixel spacing provides ample room in five micrometer design technology to fabricate tri-color pixels to thereby achieve a high resolution miniature color display. Because a high resolution display can be integrated onto a small area of a silicon wafer by processing techniques similar to that used to manufacture memory chips, the display 10 can be inexpensively and relatively easily manufactured by applying known processing methods. This relationship to memory chip technology further means that, similar to the well known "rule" for the cost of storage capacity, the cost-per-pixel of a display according to the present invention is likely to drop by 50% every two years.

Once a display and appropriate supporting circuitry has been formed on a silicon substrate 20 according to the present invention, the substrate 20 may be coupled to an optical interface placed between the display 10 and the user's eye to allow the user to easily focus on the display and to give the illusion that the display is significantly larger than it actually is. Techniques for doing this are well known. Because the plasma display can be positioned very close to the eye and the images are optically coupled directly to the eye (rather than being projected to a screen), a clear image can be viewed without requiring the pixels to be very bright. The display can be enhanced by placing it in dark surroundings such as a sealed eyepiece or light shield.

A miniature plasma display according to the invention can be used to display information from hand-held computers or "personal digital assistants." Applications include wireless fax and Internet, inexpensive video phone/video conferencing devices as well as "viewfinders" for video and digital cameras. Because the display according to the present invention is self-illuminating and may be formed as part of a conventional semiconductor chip, the display can be integrated with other devices to create single packages that combine previously separate functions. For example, a CCD video camera, amplifiers and/or image processing circuits can be formed on one side of a substrate and connected to a miniature plasma display formed on the opposite side to create, for example, a monolithic night vision display the size and shape of an eyeglass lens.

Figure 8:
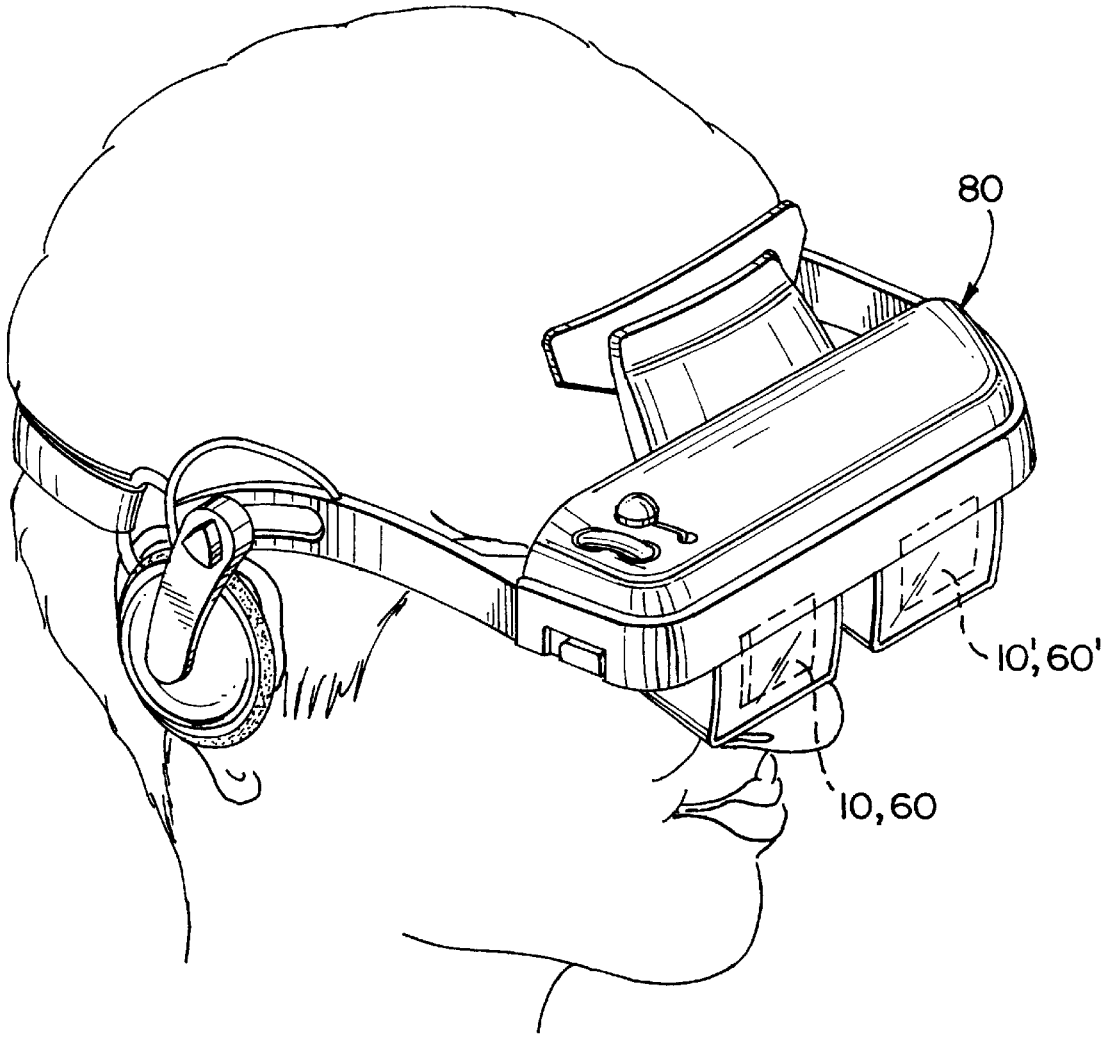
FIG. 8 is a perspective view of a head mounted display containing integrated miniature plasma displays of FIG. 7.

Two displays 10, 10' may be combined in a single "eyeglass" type assembly to enable the user to view a projected image in three dimensions. Each display will show the same image but from a slightly different viewpoint. The two images are processed by the user's brain into a single to three dimensional ("3D") images as known in the art of stereoscopes. This device may be combined with a digital camera to form an inexpensive 3D viewer. The assembly can also be head mounted and used as the display element of a virtual reality environment. (See FIG. 8).

While the invention has been particularly shown and described with reference to preferred embodiments thereof, it will be understood by those skilled in the art that various changes in form and details may be made therein without departing from the spirit and scope of the invention.

I claim:

1. A plasma display comprising:

a first substrate being a semiconductor;

a first set of conductors proximate said first substrate;

a second set of conductors made of a non-sputterable material, formed on said first substrate and disposed at an angle to said first set of conductors, said second set of conductors crossing over said first set of conductors at a preselected distance therefrom to form an array of crosspoints;

said first and second set of conductors separated by an insulating layer disposed on at least a portion of said first set of conductors;

said insulating layer having a hollow cavity associated with each said crosspoint;

a second substrate having a plurality of hollow tubes therein;

each said hollow tube having an upper and lower end, being open on its lower end, having axial walls and having a terminating wall at its upper end, said terminating wall including an electrically conducting layer;

said second substrate abutting said first substrate so that the lower ends of said tubes substantially oppose said hollow cavities at said crosspoints to thereby form an array of substantially hollow chambers defined by said hollow cavities and said hollow tubes; and said hollow chambers being filled with a gas.

2. The plasma display of claim 1, wherein each said hollow tube is open on its upper end, the terminating walls of said plurality of hollow tubes comprising a transparent coverplate abutting said second substrate.

3. The plasma display of claim 2, wherein said cover plate includes an indium tin oxide layer.

4. The plasma display of claim 1, wherein each said terminating wall is integral to said second substrate.

5. The plasma display of claim 1, further comprising an insulating layer disposed on at least a portion of said first set of conductors.

6. The plasma display of claim 1, wherein said first set of conductors is diffused into said first substrate.

7. The plasma display of claim 1, wherein said second substrate is a material thermally matched to said first substrate.

8. The plasma display of claim 7, wherein said first substrate is silicon and said second substrate is a glass.

9. The plasma display of claim 1, wherein said second substrate is bonded to said first substrate with either a metal ring or a glass bead.

10. The plasma display of claim 1, wherein said preselected distance is chosen so that light emissive discharge initiates within the cavity associated with a particular crosspoint only when a voltage greater than or equal to the Paschen minimum firing voltage is applied across the conductors at said particular crosspoint.

11. The plasma display of claim 10, wherein said gas comprises at least one of Argon, Neon, and Xenon.

12. The plasma display of claim 10, wherein said gas is at about ten atmospheres and said preselected distance is about one micrometer.

13. The plasma display of claim 10, wherein said gas is at a pressure of at least about 0.8 atmospheres.

14. The plasma display of claim 1, wherein said tubes are substantially longer than they are wide.

15. The plasma display of claim 1, wherein said tubes taper in a predetermined direction.

16. The plasma display of claim 1, further comprising a phosphor layer disposed on the axial walls of said tubes.

17. The plasma display of claim 1, further comprising a reflective layer disposed on the axial walls of said tubes and a phosphor layer disposed on said reflective layer.

18. A plasma display comprising:

a first substrate;

a first set of conductors formed on said first substrate;

a second set of conductors formed on said first substrate and disposed at an angle to said first set of conductors, said second set of conductors crossing over said first set of conductors at a preselected distance therefrom to form an array of crosspoints, said preselected distance chosen so that light emissive discharge initiates within a cavity associated with a particular crosspoint only when a voltage greater than or equal to the Paschen minimum firing voltage is applied across the conductors at said particular crosspoint;

a second substrate having a plurality of hollow tubes therein;

each said hollow tube having an upper and lower end, being open on its lower end, having axial walls and having a terminating wall at its upper end, said terminating wall including an electrically conducting layer;

said second substrate abutting said first substrate so that the lower ends of said tubes substantially oppose said cavities at said crosspoints to thereby form an array of substantially hollow chambers defined by said cavities and said hollow tubes; and said hollow chambers being filled with a gas at a pressure of at least several atmospheres.

19. The plasma display of claim 18, wherein each said hollow tube is open on its upper end, the terminating walls of said plurality of hollow tubes comprising a transparent coverplate abutting said second substrate.

20. The plasma display of claim 19, wherein said cover plate includes an indium tin oxide layer.

21. The plasma display of claim 18, wherein each said terminating wall is integral to said second substrate.

22. The plasma display of claim 18, further comprising an insulating layer disposed on at least a portion of said first set of conductors.

23. The plasma display of claim 18, wherein said first substrate is a semiconductor.

24. The plasma display of claim 23, wherein said first set of conductors is diffused into said first substrate;

said second set of conductors is made of a non-sputterable material; and said first and second set of conductors are separated by an insulating layer disposed on at least a portion of said first set of conductors.

25. The plasma display of claim 18, wherein said second substrate is a material thermally matched to said first substrate.

26. The plasma display of claim 25, wherein said first substrate is silicon and said second substrate is a glass.

27. The plasma display of claim 18, wherein said second substrate is bonded to said first substrate with either a metal ring or a glass bead.

28. The plasma display of claim 18, wherein said gas comprises at least one of Argon, Neon, and Xenon.

29. The plasma display of claim 18, wherein said pressure is at about ten atmospheres and said preselected distance is about one micrometer.

30. The plasma display of claim 18, wherein said tubes are substantially longer than they are wide.

31. The plasma display of claim 18, wherein said tubes taper in a predetermined direction.

32. The plasma display of claim 18, further comprising a phosphor layer disposed on the axial walls of said tubes.

33. The plasma display of claim 18, further comprising a reflective layer disposed on the axial walls of said tubes and a phosphor layer disposed on said reflective layer.

* * * * *